US005695102A

United States Patent [19]

Jackson

[11] Patent Number: 5,695,102

[45] Date of Patent: Dec. 9, 1997

[54] ELASTIC SHOULDER STRAP

[75] Inventor: Terry R. Jackson, Bozeman, Mont.

[73] Assignee: William R. Heckerman, Jackson, Wyo.

[21] Appl. No.: 430,614

[22] Filed: Apr. 28, 1995

[51] Int. Cl.[6] ..... A41F 15/00; A45F 3/12

[52] U.S. Cl. ..... 224/264; 224/257; 24/301; 57/225; 267/69

[58] Field of Search ..... 224/264, 259, 224/260, 150, 257, 258; 24/300, 301; 294/74, 152, 156; 267/69, 74; 57/225

[56] References Cited

U.S. PATENT DOCUMENTS

| | | | |
|---|---|---|---|
| 518,681 | 4/1894 | Tyler . | |
| 860,395 | 7/1907 | Lindsey . | |
| 1,055,077 | 3/1913 | Quirk | 224/264 |
| 1,109,564 | 9/1914 | Batchelder . | |
| 1,323,701 | 12/1919 | Lethern . | |
| 1,341,406 | 5/1920 | Ade . | |
| 1,723,276 | 8/1929 | Gottlieb . | |
| 1,790,695 | 2/1931 | Behrman . | |
| 1,881,654 | 10/1932 | Kastner . | |
| 1,924,598 | 8/1933 | Eustis | 428/250 |
| 1,962,585 | 6/1934 | Faure-roux | 294/74 |
| 2,091,999 | 9/1937 | Madge et al. | 57/225 |
| 2,101,003 | 11/1937 | Fox | 57/225 |
| 2,101,004 | 11/1937 | Fox | 57/225 |
| 2,132,616 | 10/1938 | Hardie | 267/69 |
| 2,140,333 | 12/1938 | Reiter . | |
| 2,146,966 | 2/1939 | Lilley | 57/225 |
| 2,213,659 | 9/1940 | Vincke | 57/225 |
| 2,264,481 | 12/1941 | Peterson . | |
| 2,521,903 | 9/1950 | Crapsey, Jr. et al. . | |
| 2,541,449 | 2/1951 | Vickers | 294/74 |
| 2,628,749 | 2/1953 | Ryden . | |
| 2,631,350 | 3/1953 | Parker . | |
| 2,651,441 | 9/1953 | Rau et al. . | |
| 2,655,195 | 10/1953 | Curtis | 428/250 |
| 2,779,521 | 1/1957 | Granberg . | |
| 2,806,275 | 9/1957 | Stoll . | |
| 2,830,747 | 4/1958 | Creste . | |
| 2,865,978 | 12/1958 | Modrey | 57/225 |
| 2,875,116 | 2/1959 | Smith | 428/250 |
| 3,296,673 | 1/1967 | Kirkpatrick . | |
| 3,352,467 | 11/1967 | Parlante et al. . | |
| 3,435,867 | 4/1969 | Hyden | 224/264 |
| 3,448,464 | 6/1969 | Jonas . | |

(List continued on next page.)

FOREIGN PATENT DOCUMENTS

| | | | |
|---|---|---|---|
| 104538 | 4/1984 | European Pat. Off. . | |
| 1406502 | 6/1965 | France . | |
| 1423486 | 11/1965 | France . | |
| 590382 | 1/1934 | Germany . | |
| 19943 | 10/1955 | Germany . | |
| 2827707 | 1/1979 | Germany | 57/225 |
| 224268 | 11/1942 | Switzerland . | |
| 9416595 | 8/1994 | WIPO | 224/264 |

OTHER PUBLICATIONS

LIFT–ALL TRX–coated nylon web slings; Bulletin SW–6, 1973.

*Primary Examiner*—Henry J. Recla
*Assistant Examiner*—Gregory M. Vidovich
*Attorney, Agent, or Firm*—Cushman Darby & Cushman IP Group of Pillsbury Madison & Sutro LLP

[57] ABSTRACT

A shock absorbing carrying strap for easing the ability to support loads. The strap includes two webbing sections, each of which includes an outer end and a connecting section to permit attachment to loads. The two webbing sections are also connected to a central elastic portion. That central elastic portion includes an outer envelope of elastic material which encloses an elastic strip connected to and between the two webbing sections. The outer envelope is secured to the elastic strip, and preferably to the webbing adjacent the elastic strip, so that the outer envelope and elastic strip form a composite member. The outer envelope is finished by binding the marginal edge and by applying a finishing cover over each end and where each webbing section extends from the central portion by a variety of techniques.

19 Claims, 3 Drawing Sheets

U.S. PATENT DOCUMENTS

| | | | |
|---|---|---|---|
| 3,692,361 | 9/1972 | Ivarsson | 267/69 |
| 3,767,095 | 10/1973 | Jones . | |
| 4,036,546 | 7/1977 | Thompson et al. . | |
| 4,068,355 | 1/1978 | Rey . | |
| 4,069,954 | 1/1978 | Rauch . | |
| 4,085,872 | 4/1978 | Foo . | |
| 4,124,244 | 11/1978 | Bryant | 294/74 |
| 4,209,044 | 6/1980 | Taki | 294/74 |
| 4,247,028 | 1/1981 | Maitani et al. . | |
| 4,372,301 | 2/1983 | Hubbard et al. . | |
| 4,387,490 | 6/1983 | Blackburn et al. . | |
| 4,401,246 | 8/1983 | Dickinson et al. . | |
| 4,550,869 | 11/1985 | Johnson . | |
| 4,606,687 | 8/1986 | Mantela et al. | 24/300 |
| 4,827,578 | 5/1989 | Heckerman et al. . | |
| 4,924,557 | 5/1990 | Heckerman et al. . | |
| 4,976,388 | 12/1990 | Coontz | 224/264 |
| 5,018,652 | 5/1991 | Holtzclaw, Jr. | 224/264 |
| 5,083,522 | 1/1992 | Ashrow | 267/69 |
| 5,143,266 | 9/1992 | Heckerman et al. | 224/150 |
| 5,356,681 | 10/1994 | Ichikawa et al. | 428/36.8 |
| 5,419,475 | 5/1995 | Naritomi | 224/264 |
| 5,422,165 | 6/1995 | Arnold | 428/250 |
| 5,512,356 | 4/1996 | Haager | 428/250 |

ELASTIC SHOULDER STRAP

FIELD OF THE INVENTION

The present invention relates to an elastic load support centered above a composite central elastic portion that includes or is interconnected to load supporting straps.

BACKGROUND OF THE PRESENT INVENTION

For many years it has been customary to carry a variety of loads, such as golf bags, briefcases, mail pouches, even relatively light bags and suitcases, with some type of carrying strap. Such carrying straps have been used over one shoulder, around necks or as with backpacks, by pairs of straps.

Traditionally, such straps that have been totally non-elastic. In more recent times straps have been made of leather, nylon webbings as well as other various padded straps. When using such inelastic straps, the carrying of loads would only be eased by whatever amount of padding was placed between the strap and the individual. Shocks developed from the load itself would be transmitted directly to the individual and no shock absorption would be present.

Attempts to solve such load handling and shock absorbing problems have been numerous. One such attempt is set forth in Johnson, U.S. Pat. No. 4,550,869. In this proposal, a tube was made out of a flexible yet relatively non-elastic material, such as leather, vinyl or canvas, in which a plurality of individual foam pads or blocks of elastic cushioning material were simply inserted. The flexible material was then stitched together or connected between the blades so that accordion-like folds or pleats were formed. As load is applied to the flexible material or fabric, the individual pads or blocks within the tube would yield and be compressed and the accordion-like folds or pleats provided some longitudinal elasticity so as to absorb some load force and provide some extension. The foam blocks or pads were held in place in an end-to-end fashion by stitching or a connection made in the flexible fabric between adjacent blocks or pads.

Another attempt to resolve this problem is set forth in Coontz, U.S. Pat. No. 4,976,388. In Coontz, a simple neoprene layer forms a cushion connected to the top exterior surface on an auxiliary strap. That strap is formed from two non-stretch portions and a center elastic piece which are stitched together. An elastic cover strap is then stitched in place over the auxiliary strap at spaced apart locations to provide an improved appearance and assists in improving mechanical function. The ends of the cover and non-stretch portions of the straps are bent in a U-shaped fashion about each end of the neoprene pad so that conventional snap fasteners can be provided at each end.

Notwithstanding the use of elastic stretchable strap portions sewed to the neoprene there is no other interconnection between the two exterior straps and the neoprene pad so that the combined structure only has stretch characteristics associated with the individual elements since they are floating freely one with respect to another. Also, all the parts are open and exposed to being caught or snagged.

Another attempt to resolve this problem was set forth in Heckerman et al., U.S. Pat. No. 5,143,266. This device also used a neoprene pad, which can include a nylon cover, as well as an auxiliary strap, with the neoprene pad and the auxiliary strap being connected together, again at spaced apart locations, by stitching. The strap can be a strong fabric in the form of a stronger elastic material. As with Coontz, the strap is fastened only to one exposed side of the neoprene pad.

With each of these prior art devices, the resulting strap has either an irregularly shaped surface that is not suitable for printing and design purposes, or the exterior surface is covered with additional straps that can get in the way during use. Such exposed items can become twisted and do not provide a necessarily clean surface for aesthetic purposes. Likewise, the resulting structures have only the stretch characteristics of each of the individual elements, there being no interrelationship between such elements that provides an improved or modified stretch nor is there a convenient way to fine tune stretch characteristics of the composite structure.

SUMMARY OF THE PRESENT INVENTION

The present invention solves these problems and relates to a composite elastic member and more specifically to the main central elastic member. Such a composite elastic member according to this invention, that will be incorporated into a carrying strap, is formed in a way that produces a unitary shock absorbing structure which when finished, by appropriate choices of components, provides stretch characteristics and shock absorbing qualities that are tuneable for varying types of end uses and load carry situations. Significantly, the attachment of individual components to one another yields a combined stretch and load absorbing capacity that is enhanced over that supplied by the individual elements.

A strap according to this invention starts with the main elastic central portion. From that central portion two webbing portions, preferably comprised of a non-stretch material although certainly a strong stretch material could also be used, as well as an elastic central portion. These webbings can be formed integrally with the central portion or be removably connected to it by a variety of techniques. The central portion begins by forming an outer envelope from two layers of soft stretchable material, which may or may not be fabric covered. An internal elastic member is joined to this outer envelope thereby forming a composite structure. The elastic strip can extend from one end of the central portion to the other unit. It can extend between the two webbings or short pieces of such webbing material. The outer envelope also will preferably cover the connection between the elastic member and the two opposing end sections. The central portion is then finished by suitable edge binding material and separate end covers.

The connection between the internal elastic member and the outer envelope can be effected through a variety of techniques, as well as in a variety of areas. Included within such techniques would be a flexible and stretchable form of stitching, including use of elastic threads and sonic welding, as well as non-hardening flexible adhesives such as, for example, spray-on contact cements, mixed and spread silicone adhesives, or even injected resin foams, or combinations thereof. As to where such connection is placed, it is preferred that both sides of the elastic member be connected to the internal surfaces of the outer envelope. However, where elastic or stretchable strapping is used, the stitch can extend down portions of the outer envelope and inner elastic member interface. This would claim an appropriate connection to be made between the outer envelope and the elastic members yet permit the stretchable stitch portion to be decorative as well as the main connecting approach.

Where a non-hardening adhesive or foam is used as the connection approach, it is preferred to have the internal surfaces of the outer envelope adhered to the inner elastic member, but it is also possible to make an excellent per-forming strap if only one side of the internal elastic member is adhesively bonded within and to that outer envelope.

The webbing ends, whether short and terminating at the opposing ends of the central portion or when they have a longer length, can be connected to one of a variety of connectors, either in the form of additional straps, snap fasteners, rotatable hooks or other conventional type connecting devices, so that either the central portion itself, or the whole strap, can be easily connected and disconnected from a load.

Other objects, features, and characteristics of the present invention will become apparent upon consideration of the following description in the appended claims with reference to the accompanying drawings, all of which form a part of the specification, and wherein referenced numerals designate corresponding parts in the various figures.

DETAILED DESCRIPTION OF THE PREFERRED EMBODIMENTS OF THE PRESENT INVENTION

Figure 1:
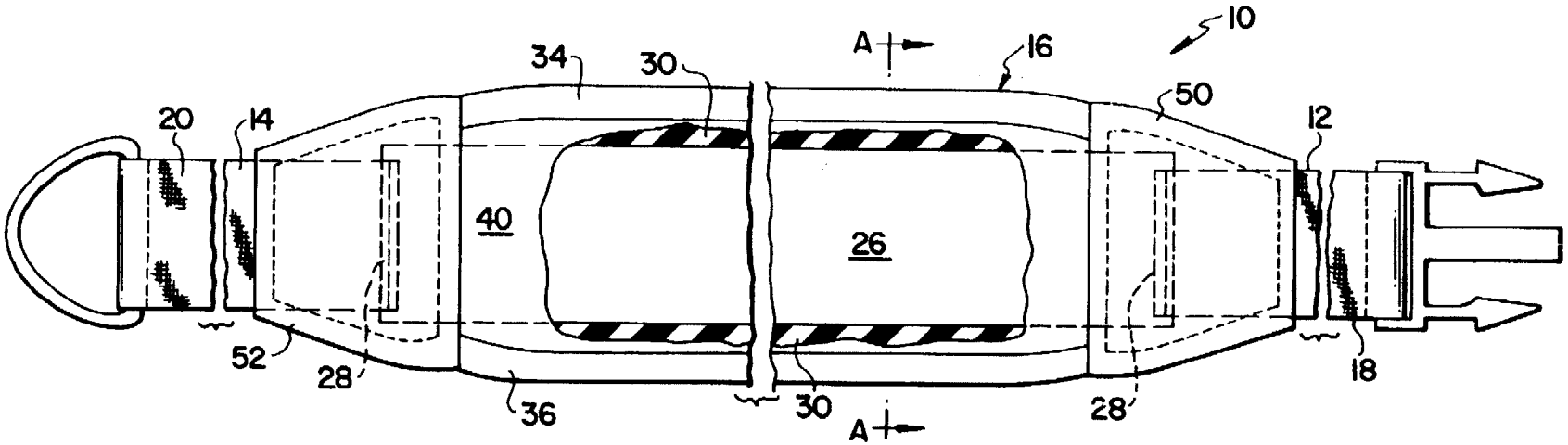
FIG. 1 is a top plan view of the strap according to the present invention, a portion of which has been diagrammatically cut away to show the internal structure.

Turning to FIG. 1, the shock absorbing and load bearing carrying strap is generally indicated at 10 and is comprised of two relatively non-elastic webbings 12 and 14 connected to a central portion, generally indicated at 16. Webbings 12 and 14 can be long and have outer ends 18 and 20 that are secured to one of a number of types of conventional connectors, or they can be provided with a releasable clip type structure, such as a conventional quick disconnect or side release type buckle, so that various types of connecting mechanisms can be employed. Also, it should be understood that webbings 12 and 14 can be provided with loop connectors that would allow them to be lengthened or shortened depending upon the load being carried and the exact use to which the carrying strap is to be put. Included within the concept of the connectors includes swivel snap hooks, D-rings, per loop connectors comprised of a quarter inch webbing, flip over and lockable straps. Webbings 12 and 14 could also be short enough so that each provides an internal connection with an internal elastic strip 26 but then extends only a short distance out of the ends of central portion 16. That distance need be only long enough to be connected to a conventional connector, including, for example, a D-ring or a quick release device.

Figure 3:
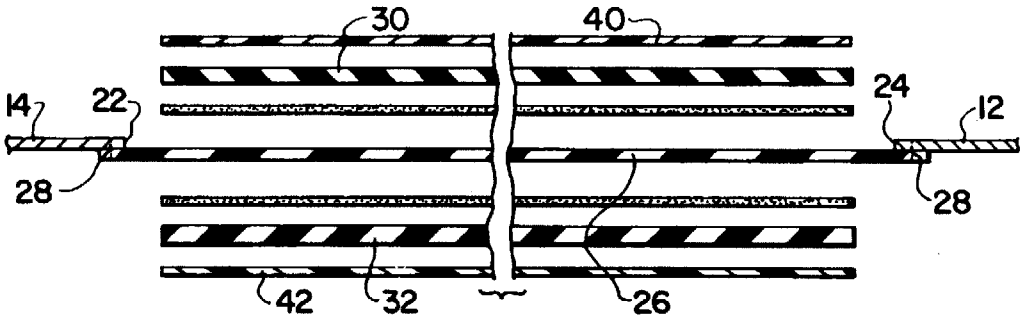
FIG. 3 is a partially exploded side elevational view of the present invention.

Webbings 12 and 14 also have opposite or interior ends 22 and 24, as shown in FIG. 3, that permit them to be respectively connected to an elastic strip 26, such as by stitching as indicated at 28, rivets or stitching or other permanent or fixed bond.

Central portion 16 includes upper and lower stretchable pads 30 and 32, respectively, with the finished outer lateral edges being covered preferably with an elastic binding as at 34 and 36.

Figure 2:
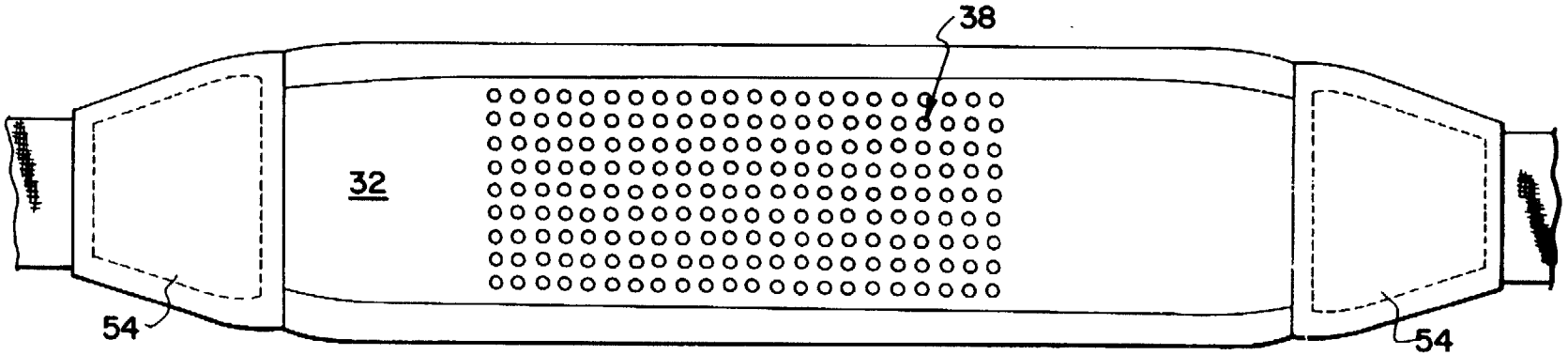
FIG. 2 is a bottom plan view of the present invention.

As shown in FIG. 2, the bottom or lower stretchable pad, preferably the one that will ride against an individual's shoulder, neck or other area, can be provided with a plurality of rubberized or slip preventing features or indicia such as the dots, or other shapes, for example, can be stripes, open rings or squares or diamonds generally indicated at 38. These slip preventing features are preferably blends comprised of a plastisol or other rubberized-like compound that can be applied by silk screen printing techniques to provide resistance and prevent slippage. The stretchable pads 30, 32 can be provided also with an outer cover, as indicated at 40 and 42. Covers 40 and 42 can be sealed to the pads or otherwise bonded or formed therewith and will provide a convenient exterior surface for printing and for receiving the slip resistance elements 38. Pads 30 and 32 are preferably foam pads formed, for example, from neoprene or other stretchable foams or blends. However, other stretchable material, including stretch fabrics or layers of stretch material could be used. What is desired is to be able to build into the central portion desired amounts of elasticity to sufficiently control loads.

Each of the ends of the central portion are preferably closed with a strap end closure, sometimes called a bag term end, separately indicated at 50 and 52, which are preferably stitched in place as indicated at 54. These end closures could also be held in place by adhesives.

The outer cover 40 and 42 can be all forms of elastic, fabric or material, including that constructed of nylon, lycra, polyester, or combinations thereof, and the fabric can be either knit or woven. Further, additional materials such as leather and denim or other forms of more inelastic fabric can be used if shirred or bunched in a fashion that would permit the desired level of longitudinal expansion of the remaining internal elastic components.

The upper and lower stretchable pads 30 and 32 are preferably comprised of 100% neoprene so that each will have good shape and elastic retention qualities. The pads 30 and 32 can be comprised of foam having the desired elasticity which can be rubber blends, EVA blends and neoprene blends, as well as polyfoams. The thickness of the top and bottom pads 30 and 32, respectively, can be either the same or can be varied, preferably with the lower pad 32 being thicker, with thicknesses of those pads varying from about 3/32 to about ½ inches, preferably from about ⅛ to about ⅜ inches.

The elastic strip 26 can be comprised of a variety of elastic materials having varying co-efficients of elasticity. The central portion 16 can vary in its length from about 5 to about 25 inches and is preferably about 10 to 18 inches in overall length from one end of closure 50 to the opposite end of closure 52. Webbings 12 and 14 can have a length ranging from about 2 inches to 36 inches, with the preferred length preferably being about 14 to 24 inches, with a stretch length still permitting your attachment member to be provided at each end of central portion 16.

It is preferred that the elastic strip 26 extends substantially along the full length of the central portion 16 so that for a 13 inch long central portion 16 the elastic strap 26 could be approximately 10 to 11 inches. In order to limit the stretch, a stiffer or heavier piece of elastic could be used, or alternatively the length could be shortened to be about five to seven inches to create the same or a similar effect.

Figure 6:
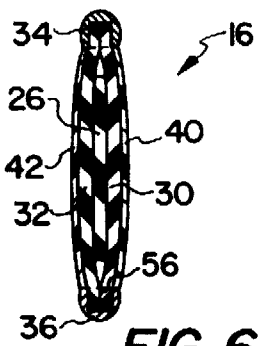
FIG. 6 is a cross-sectional view also along line A—A of FIG. 1 showing a cross-sectional view of a finished part of the central portion.
Figure 4:
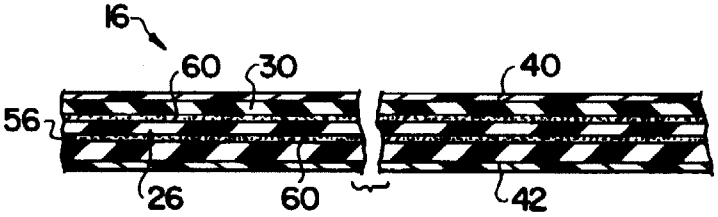
FIG. 4 is a diagrammatic partially exploded cross-sectional view of the central portion taken along cut line A—A of FIG. 1 and showing the use of a spray-on contact adhesive as the binding material.

As indicated previously, the stretchable pads 30 and 32 are each preferably bonded to both the elastic strip 26, on each side thereof, and to each other around their marginal edges beyond strip 16, such as indicated at 56, which is perhaps best seen in FIGS. 4 and 6.

With reference to FIG. 4, one adhesive alternative indicated at 60, is a contact cement such as, for example, 3M's high strength adhesive Spray 90, spray-on contact cement, Rubatex R27705 black neoprene contact adhesive material, or Bull's Eye Brand Contact Cement, Product Identification No. Bull's Eye No. 110 mist adhesives, Bull's Eye TABLELA low tack adhesive. Once contact cement is sprayed on the interior surfaces of pads 30 and 32, the contact cement will quickly become tacky so that those surfaces can be placed on the elastic strip 26 which has been previously connected, such as by stitching to webbings 12 and 14. When pressed down, pads 30 and 32 will adhere to the elastic strip 26 and will also adhere to each other along those lateral edges where they extend beyond elastic strip 26.

Thereafter, the edge binding 34 and 36 can be secured in place, with the binding preferably providing both a suitable way to dress the lateral edges of the layers forming the composite central portion 16. The binding can be the same as that used for the outer cover or skin of the pads 30 and 32, so that in addition to creating a finished edge, the binding can also provide some additional elasticity and stretch co-efficients of the central pad area can be improved thereby. Edge bindings 34 and 36 can be secured by stitching, a suitable adhesive or otherwise bonded to pads 30 and 32. Alternatively, the edges of the neoprene pads can simply be otherwise sealed, coated with a sealant or finishing material, or simply welded in place.

Thereafter, the bag term ends 50 and 52, which have preferably been separately formed, either by injection molding if they are comprised of a rubber, a flexible resin compound, or other moldable material, or formed of leather or other decorative material or fabric can be fixed in place. These bag term ends can be slipped over the webbings 12 and 14 from each end, slid into place and then sewn into the position shown in FIG. 1 covering and protecting the ends of the neoprene pads in the central portion. It is preferred that the bag term ends be sewn, as at 54, so that sewing provides an additional connection between webbings 12 and 14 and the elastic strip 26, and also helps to firm up and strengthen each of the ends of the pads 30 and 32.

Figure 5:
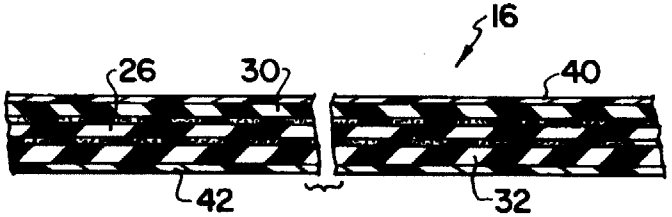
FIG. 5 is a cross-sectional view taken along line A—A of FIG. 1 and showing the use of polyurethane foam as the binding material.

As an alternative, and with reference to FIG. 5, the adhesive used to develop the composite structure of the central portion 16 can be a silicon adhesive, such as RTV manufactured by General Electric. This adhesive can be preferably either prepared as a two part mix and then spread onto the interior surfaces of pads 30 and 32. The RTV adhesive can alternatively be applied in the form of a stiffer mix in the form of an expressed caulk type material. When that form is employed the outer envelope is first partially assembled. The pads 30 and 32 can be placed on the elastic strip 26, the edges can be bound, such as by binding each of the lateral edges with bindings 34 and 36, and a bag term at one end can be fixed into place. That will leave the other and opposite end of the stretchable pads 30 and 32 open providing a passage leading into the outer envelope with respect to the interior surface of pads 30 and 32 and the elastic strip 26. Then, a caulking nozzle can be inserted into the open end thus formed, so that the silicon adhesive can be injected or expressed into the interior cavity of the outer envelope, either on one or both sides of the elastic strip 26. By then applying pressure along the length of the stretchable pads 30 and 32 from the exterior, the silicon adhesive can be pressed outwardly and about the interior surfaces of pads 30 and 32, and along the exterior surfaces of elastic strip 26. Thereafter, the remaining bag term end can be positioned at the opposite end and stitched in place, thus closing that end. This procedure will also provide a way of interconnecting the interior surfaces of the stretchable pads 30 and 32 to the elastic strip 26, as well as to portions of the webbing within the outer envelope defined by the stretchable pads 30 and 32, with all of those being adhered into an integral and operating composite unit.

As yet another alternative, the same procedure could be used for initially assembling the outer envelope of the stretchable pads 30 and 32, including securing the lateral edge bindings 34 and 36 and by attaching one end closure, leaving the opposite end open. Thereafter, a resin foam, such as, for example a polyurethane resin foam can be injected into the cavity formed by that outer envelope of the upper and lower stretchable pads 30 and 32. Such a polyurethane could be a two part mixture of Denflex RX-32018-A Black Base and Denflex 9951 prepolymer. As the foam develops it will move about the interior of that cavity within the outer pads as well as about the exterior surfaces of elastic strip 26 and when cured the foam will secure all the surfaces inside the outer envelope together. Thereafter, the opposite end closure would again be positioned and secured in place. This way, the injected resin foam serves as an adhesive to bind the interior surfaces of the stretchable pads to the exterior surfaces of the elastic strip as well as the interior ends 22 and 24 of the webbing into an integral unit. The injected resin foam itself also becomes part of the integral composite elastic structure and will add its own additional stretch resistance characteristics thereby increasing the stretch co-efficient of the composite central portion 16 structure.

Thus, the connection approach used to provide a flexible, non-hardening joint between the individual components and the central portion 16, that permits the interconnected components to collectively stretch in parallel with each other, can vary from elastic stitching, spray-on contact cements, silicon adhesives, and injected foam materials. The adhesives can also comprise other non-hardening flexible adhesives.

With respect to evaluating the elasticity or elastic stretch characteristics of the composite structure, there are two specific variables. The first relates to the percent stretch, which refers to the point where the elastic has been stretched to its limit and will not stretch any further. For example, a 10 inch piece of elastic formed from a 100% stretch material will reach its stretch limit when stretched, to a length of 20 inches. Preferably, the desired range of percent stretch for the present invention will be less than 100% and preferably from 25% to 100%.

Figure 8:
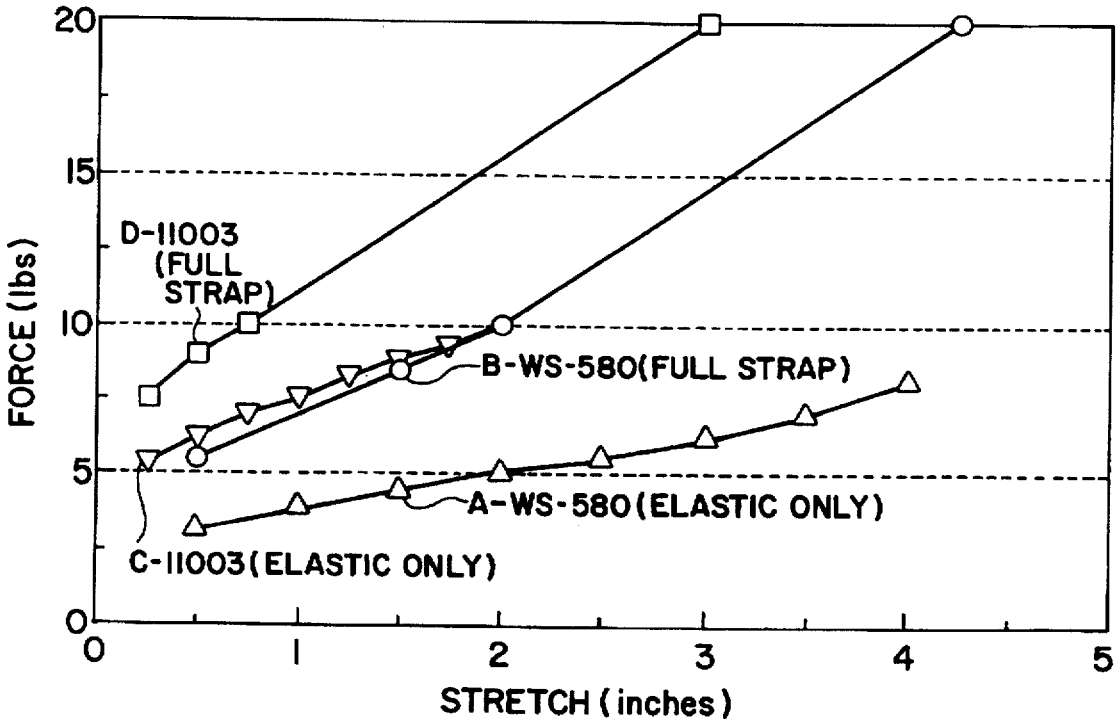
FIG. 8 shows the coefficient of structure for several straps.

The second variable is the co-efficient of stretch. This relates to the stretch per inch versus an applied force. Starting forces can vary from, for example, 1 to 50 pounds, with the preferred co-efficient of stretch varying from approximately 1.0 lbs/inch to about 4 lbs/inch. It has also been found that once the central portion is finished and constructed with all the components assembled and adhered together, the co-efficient of stretch for the composite structure is different from and greater than the simple sum of the components used to form that composite structure. For example, the graph in FIG. 8 shows the co-efficient of structure for several straps and allows a comparison between adhered and unadhered structures.

Four plots or sets of data points are labeled A, B, C and D. The plot identified by A relates to an unadhered composite structure while plot B is for the adhered structure. Each of these test members was formed using a 1.5 inch wide elastic strip manufactured by the John Howard Company, Inc., identified as a part number W5-580. This elastic strip is a woven product comprised of strands of rubber that are wrapped with a cotton thread. A ten inch long piece of this elastic strip was used so that after connection to the webbings 12 and 14, the effective stretchable length of the elastic strip was approximately 9.5 inches. The stretchable pads used to form the outer envelope included a 5/32 thick neoprene pad on one side and 1/8 thick neoprene pad on the opposite side. A spray-on contact cement, Bull's Eye No. 110 Mist, was applied to the interior surfaces of the neoprene pads and the pads were pressed onto the elastic strip covering the joint between the elastic strip and the webbings. The lateral edges were bounded with a sewn on lycra binding. A piece of the John Howard elastic developed a co-efficient of stretch as depicted in graph A. A half inch stretch occurs at about 3.75 lbs of load and 4 inches of stretch is developed at about 8 lbs. However, a composite test member formed with the same John Howard elastic connected to the outer envelope pads by the spray on adhesive on all interior sides, is shown by graph B. An initial stretch of one half inch occurs about 5.5 lbs. by load, and a ten pound load stretches the composite structure only about two inches. Since this composite strap stretches a total of two inches at a ten pound load in tension, this translates to two inches of total stretch for a 20 lb load carried by the carrying strap slung over one shoulder as there is a ten pound load on each end of the strap.

As a heavier weight example, the same neoprene envelope was used but the elastic portion was changed to a ten inch long piece of elastic from Lea & Sachs, identified as Product No. 11003. This piece of elastic was approximately 1.5 inches wide and had an effective stretchable length of 9.5 inches. Prior to being connected together, the elastic produced a co-efficient of stretch indicated by graph C, with a half inch of stretch being effected by a six pound load and with a ten pound load stretching the band two inches. Mowever, once the composite structure was connected together using Bull's Eye No. 110 Mist as the adhesive, graph D shows that at a force of 10 lbs a stretch of 0.75 inches was created while a 20 lb load caused a total stretch of about 3 inches. Consequently, the co-efficient of stretch was significantly increased by the adhesive composite relative to the individual elements.

It is preferred that for a 10 pound standard load, with the tension on each side being half the total weight, that the elastic stretch characteristics of the carrying strap vary from about 0.5 inches to a maximum of about 6 inches, with the preferred range being about 1 inch to 4 inches of total stretch for an effective 10 pound tension load for a load weight of 20 pounds. Even for heavier loads, up to about 50 pounds, it is still preferred to have the preferred range of stretch still continue to be between about 1 inch to about 4 inches. This would require heavier elastic member, use of injected foam or other higher co-efficient of stretch components. What is desired is to provide shock absorption and weight distribution to make the load more comfortable without having a rigid member nor one that was too elastic so that the load would bounce.

Figure 7:
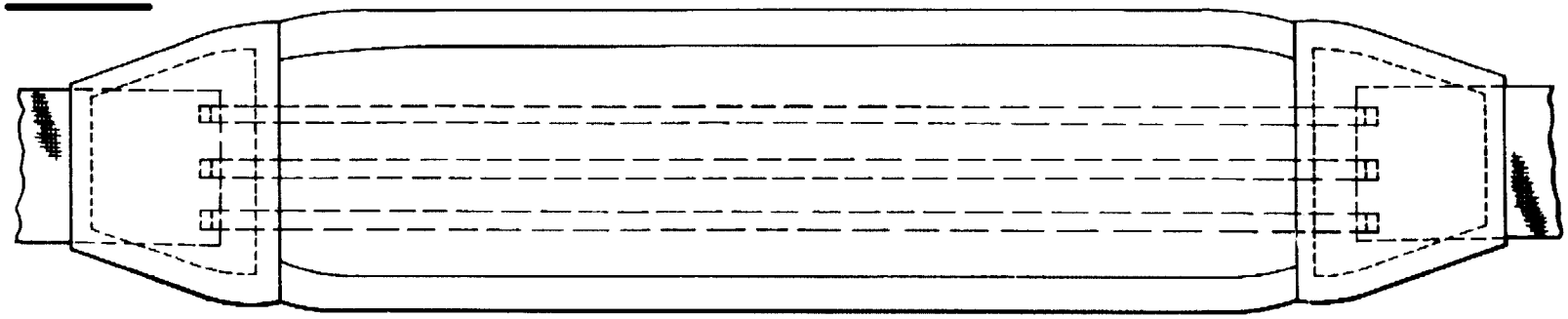
FIG. 7 is a diagrammatic top plan view showing an additional embodiment of the present invention employing a plurality of elastic members within the central portion of the carrying strap.

As shown in FIG. 7 the elastic strip in a modified central portion 16' can be in the form of a series or a plurality of individual elastic members 60. These can be solid elastic elements, bundled elastic bands, knit members or other stretchable cord-like members. This plurality of individual members can be connected together and then connected to webbings 12 and 14 or each can be separately connected directly to webbings 12 and 14. Thereafter, the outer pads forming the outer envelope can be attached to the elastic members 60 by one of the above identified approaches.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A shock absorbing, load bearing carrying strap comprising:

first and second webbing members; and a composite elastic central portion connected between said first and second webbing members, said composite elastic central portion comprising at least one elastic connector having a length and two end portions each of which is respectively fixed to one of said first and second webbing members, and an outer elastic envelope that covers said at least one elastic connector and is bonded to said first and second webbing members and said at least one elastic connector so that the composite elastic central portion exhibits controlled stretch characteristics of both said at least one elastic connector and said outer envelope and provides shock absorption relative to a load being carried.

2. The carrying strap as in claim 1, wherein the outer elastic envelope is comprised of a pair of facing stretchable foam pads.

3. The carrying strap as in claim 2, wherein said foam pads comprise neoprene.

4. The carrying strap as in claim 2, wherein said outer envelope has at least two exterior facing sides and further includes an outer textile cover layer on one of said at least two exterior facing sides.

5. The carrying strap as in claim 4, wherein said textile layer is provided on both sides of said outer envelope.

6. The carrying strap as in claim 1, wherein said central portion includes a plurality of elastic connectors.

7. The carrying strap as in claim 1, wherein said webbing members are non-stretch members.

8. The carrying strap as in claim 1, wherein said outer elastic envelope is adhesively bonded to said at least one elastic connector.

9. The carrying strap as in claim 8, wherein the adhesive comprises a non-hardening flexible adhesive.

10. The carrying strap as in claim 8, wherein the adhesive comprises a contact cement.

11. The carrying strap as in claim 8 wherein, the adhesive comprises an injected foam.

12. The carrying strap as in claim 11, wherein foam comprises a polyurethane foam.

13. The carrying strap as in claim 8, wherein said at least one elastic connector has at least two surfaces and both surfaces are adhesively bonded to said outer elastic envelope.

14. The carrying strap as in claim 1, wherein said outer elastic envelope is bonded along the length of said at least one elastic connector.

15. The carrying strap as in claim 1 wherein said outer envelope is elastically bonded to said at least one elastic connector along substantially the entire length of said outer envelope.

16. A shock absorbing and load bearing member comprising:

an elastic member bonded within a stretchable outer envelope, said elastic member having two opposing end portions interconnected with said stretchable outer envelope wherein said two opposing end portions include webbing material extending therebeyond.

17. A shock absorbing member as in claim 16 further including a connector member attached to each of said two opposing end portions.

18. A shock absorbing member as in claim 17 wherein said connector members comprise D-rings.

19. A shock absorbing member as in claim 17 wherein said connector members comprise quick release devices.

* * * * *